United States Patent [19]

LaLonde

[11] Patent Number: 4,660,348

[45] Date of Patent: Apr. 28, 1987

[54] LINEAR METAL CEILING AND WALL SYSTEM

[75] Inventor: Paul D. LaLonde, Avon, Ohio

[73] Assignee: Donn Incorporated, Westlake, Ohio

[21] Appl. No.: 612,748

[22] Filed: May 21, 1984

[51] Int. Cl.[4] ..... E04B 2/00; E04B 5/52

[52] U.S. Cl. ..... 52/762; 52/484; 52/489; 52/781

[58] Field of Search ..... 52/98–100, 52/222, 342, 145, 384, 472, 483, 484, 489, 506, 633, 669, 761, 762, 780, 781, DIG. 6, DIG. 7; 403/356, 357, 405

[56] References Cited

U.S. PATENT DOCUMENTS

| | | | |
|---|---|---|---|
| 247,370 | 9/1881 | Lloyd | 52/342 |
| 537,483 | 4/1895 | Rapp | 52/669 |
| 1,274,953 | 8/1981 | Stoehr | 52/DIG. 6 |
| 1,423,879 | 7/1922 | Potter | 52/342 |
| 3,242,626 | 3/1966 | Blok | 52/762 |
| 3,295,284 | 1/1967 | Tschiesche | 52/484 |
| 3,548,556 | 12/1970 | Vermeulen | 52/762 |
| 3,645,051 | 2/1972 | Kolesar | 52/484 |
| 3,678,641 | 7/1972 | Englund et al. | 52/484 |
| 4,041,668 | 8/1977 | Jahn et al. | 52/489 |
| 4,157,000 | 6/1979 | Sutter | 52/489 |
| 4,245,446 | 1/1981 | Judkins | 52/232 |
| 4,270,327 | 6/1981 | Van Leeuwen | 52/762 |
| 4,272,937 | 6/1981 | Brugman | 52/483 |
| 4,361,996 | 12/1982 | Smith | 52/484 |

FOREIGN PATENT DOCUMENTS

| | | | |
|---|---|---|---|
| 245521 | 1/1961 | Australia | 52/472 |
| 1381927 | 11/1964 | France | 52/762 |
| 447432 | 5/1936 | United Kingdom | 52/484 |
| 742553 | 6/1980 | U.S.S.R. | 52/781 |

*Primary Examiner*—John E. Murtagh
*Assistant Examiner*—Andrew Joseph Rudy
*Attorney, Agent, or Firm*—Pearne, Gordon, McCoy & Granger

[57] ABSTRACT

A linear panel wall and ceiling system is disclosed which provides a carrier strip which can be coiled in long lengths for storage and shipment. Such carrier strip provides longitudinally aligned and relatively closely spaced, narrow slots extending along the length of the carrier strip to provide a hinge line which divides the carrier strip into a mounting portion and a support portion. The support portion is provided with laterally extending projections at intervals along its length which are proportioned to connect with and support generally U-shaped linear pans which extend perpendicular to the carrier. At the time of installation, pieces of the carrier strip are cut from the coil and installed. In instances in which the mounting portion is mounted along a plane perpendicular to the support portion, the carrier strip may be bent along the hinge line either prior to the actual mounting or after mounting. Because continuous strips can be mounted for the full span of the wall or ceiling, the pan mounting projections are automatically spaced at proper intervals along the entire length of the carrier strip and scrap is virtually eliminated.

5 Claims, 10 Drawing Figures

LINEAR METAL CEILING AND WALL SYSTEM

BACKGROUND OF THE INVENTION

This invention relates generally to linear wall and ceiling systems, and more particularly to a novel and improved carrier structure for such systems.

PRIOR ART

Linear ceiling and wall systems are well known. Such systems generally provide an elongated, generally U-shaped carrier which provides linear pan supporting projections at intervals along its length. Such carriers are supported from the building structure and elongated U-shaped linear pans are snapped onto the carrier projections to provide a finished wall or ceiling surface. Examples of such linear ceiling and wall systems are illustrated in U.S. Pat. Nos. 3,548,556; 3,645,051; 3,678,614; 4,041,668; 4,157,000; 4,245,446; 4,270,327; 4,272,937; and 4,361,996.

In the past, the carriers for linear ceiling and wall systems have been relatively long. Commercial carriers are about 12 feet long. Residential carriers are normally about 4 feet long. Consequently, they have required packaging in long packages which are expensive to ship and difficult to handle and store. Further, when installing such prior carriers, it has often been necessary to carefully position the adjacent ends of adjacent carrier pieces, so that the intervals between projections are not changed at the joint between adjacent carrier pieces.

Still further, it has often been necessary during installation to cut some of the carrier pieces at junctions with the walls, etc., and this tends to result in scrap.

SUMMARY OF THE INVENTION

There are a number of important aspects to the present invention. In accordance with one important aspect of the invention, a novel and improved strip carrier for linear walls or ceilings is provided which is manufactured in a flat condition and is stored and shipped in a coiled condition. Consequently, long, continuous lengths of carrier can be manufactured and coiled into relatively compact packages which are easily stored and shipped. Further, since the strip carrier is supplied in long coiled strips, the individual carrier pieces can be cut to lengths prior to or during installation so that they extend the entire distance from one wall to another. This eliminates the necessity of piecing together separate carrier pieces or strips and ensures that the proper interval spacing between the carrier projections is maintained throughout the length of the given carrier installation. Further, since the pieces are cut from the coil to the exact dimension required in a given installation, scrap is virtually eliminated.

In accordance with the present invention, the carrier provides a mounting portion separated from a support portion by a plurality of aligned and closely spaced, narrow slots. The metal between the slots can be bent at the time of installation with a hingelike bending motion so that after bending, the mounting portion of the strip is substantially perpendicular to the carrier portions thereof.

Further, the carrier portion includes lateral projections at intervals along the length of the carrier which are structured to connect to and support generally U-shaped pans extending perpendicular to the carrier. The notches between the projections extend to inner extremities which are spaced from the hinge line provided by the narrow slots so that the support portion of the carrier provides an uninterrupted portion adjacent to the hinge line which facilitates the bending operation and also cooperates with the mounting portion to maintain the carrier in its straight condition after the bending operation.

In accordance with the present invention, the carrier strip can be mounted on the framing structure of a building, can be suspended to provide a suspended ceiling system, or can be mounted on the surface of an existing wall or ceiling.

These and other aspects of this invention are illustrated in the accompanying drawings, and are more fully described in the following specification.

DETAILED DESCRIPTION OF THE DRAWINGS

Figure 1:
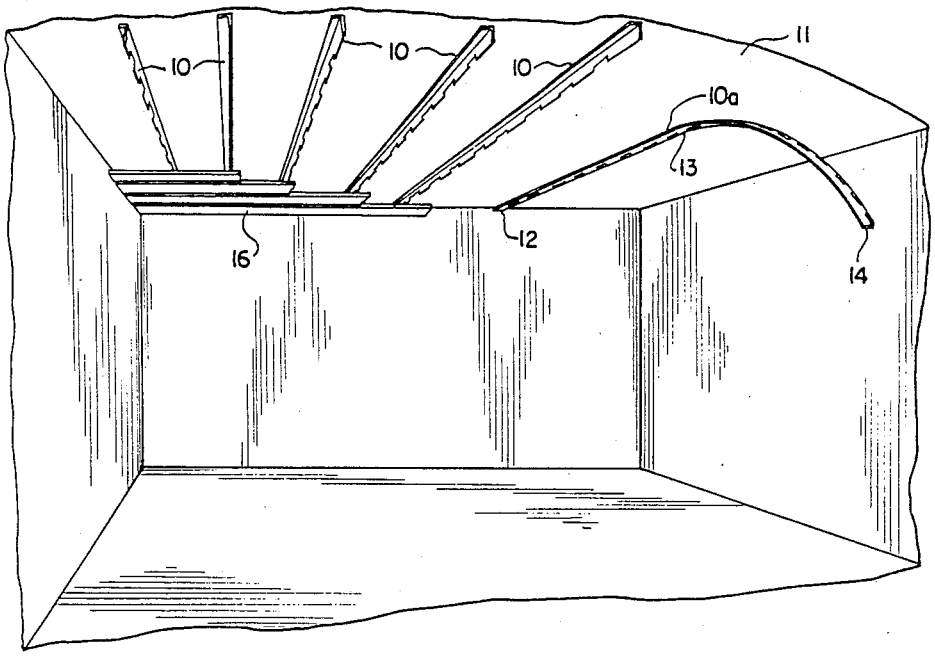
FIG. 1 is a perspective view of the carriers in accordance with this invention installed on an existing ceiling structure, and also illustrating the installation of some of the linear pans.

FIG. 1 illustrates a typical installation of a linear ceiling system in accordance with this invention at a point in the installation in which some of the carrier strips are installed and some of the linear pans are installed on the carrier strips. In such figure, a plurality of elongated carrier strips 10 are already installed on the ceiling 11 and one carrier strip 10*a* is illustrated in a partially installed condition in which it is already secured to the ceiling 11 between the points 12 and 13, and is yet to be secured to the ceiling between the points 13 and 14. Further, some of the linear pans 16 are illustrated in the installed position in which they are mounted on the previously installed carriers 10. It should be understood that in a completed installation, linear pans 16 are installed so as to cover the entire ceiling 11 and provide the exposed surface of the ceiling.

Figure 1A:
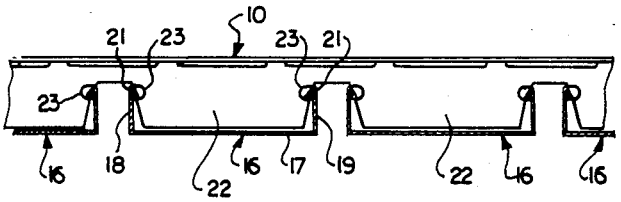
FIG. 1*a* is a fragmentary section illustrating typical linear pans mounted on a carrier in accordance with this invention.

FIG. 1*a* is a fragmentary view of a typical linear ceiling pan connected to a carrier 10 in accordance with the present invention. Such pan 16 is generally U-shaped in cross section, providing an exposed base portion 17 and a pair of upstanding legs 18 and 19, which extend from the base portion 17 to a hemmed edge at 21.

The carrier 10 is provided with spaced projections 22 at intervals along its length which are provided with grooves 23 proportioned to receive the hems of an installed linear pan 16. Therefore, the carriers provide a mounting system for a plurality of pans extending transversely with respect to the carriers, and which provide base portions 17 that cooperate to provide the ceiling or wall surface of the structure.

Figure 3:
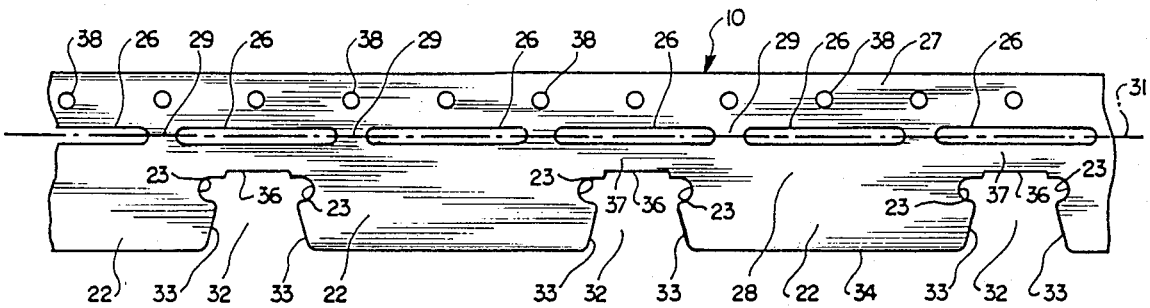
FIG. 3 is a side elevation of the carrier in its flat condition.
Figure 4:
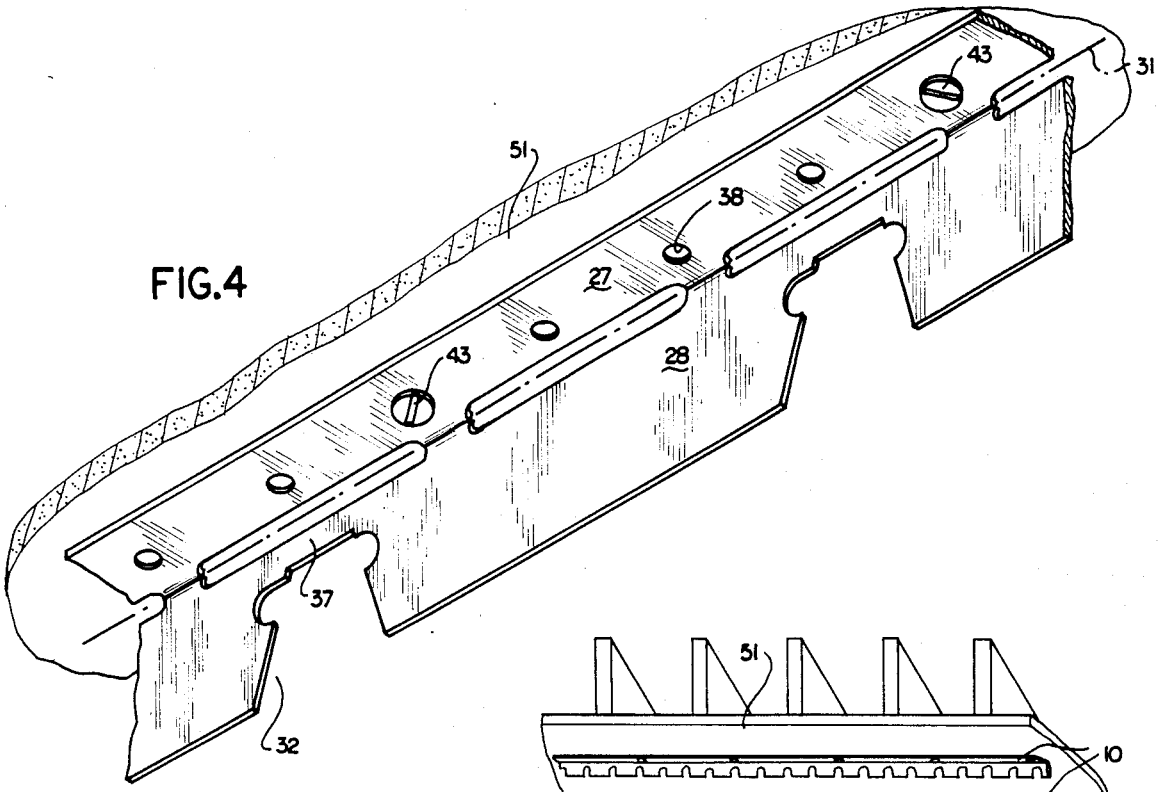
FIG. 4 is a fragmentary, perspective view illustrating the carrier after it has been installed and bent.

FIG. 3 illustrates the preferred carrier structure in accordance with the present invention. Such carrier 10 is formed of a long strip of metal providing a plurality of longitudinally aligned and spaced slots 26 which divide the carrier into a mounting portion 27 along one edge thereof and a support portion 28 along the other edge thereof. The two portions 27 and 28 are connected by relatively narrow connecting portions 29, which remain between the spaced slots 26. These connecting portions 29, in cooperation with the slots 26, define a hinge line 31 along which the carrier can be bent with a hingelike movement from a planar position to a position in which the mounting portion 27 and the carrier portion 28 extend along angulated planes intersecting substantially along the hinge line 31, as best illustrated in FIG. 4.

Referring again to FIG. 3, the projections 22 are formed along the edge of the carrier opposite the mounting portion 27 by notches or cutouts 32. Such notches 32 are shaped so as to provide the projections 22 with inclined edge portions 33, which extend inwardly from the edge 34 of the projections 22 to the grooves 23 which receive the hems 21 of the linear pans 16. With this structure, each of the projections is provided with opposed, diverging ends 33 which extend laterally in from the projection extremities at 34 to the grooves 23. These diverging ends 33 function to cam the hems 21 apart during installation.

The inner extremities 36 of the notches 32 are spaced from the hinge line 31 formed by the slots 26 to leave an uninterrupted carrier portion 37 extending the full length of the carrier 10. This uninterrupted portion cooperates with the mounting portion, which is also substantially uninterrupted along the length of the carrier, to cause the carrier to remain straight once it is bent along the hinge line and to assist in the bending of the carrier along the hinge line.

The mounting portion 27 is provided with longitudinally spaced openings 38 through which screws or nails may be inserted to mount the carrier on the supporting structure.

Preferably, the slots 26 are sized and located so that alternate slots 26 are centrally positioned with respect to each associated projection 22 and the intermediate slots 26 are centrally located with respect to the adjacent notches 32. With such an arrangement, the connecting portions 29 are spaced on opposite sides of the notches 32, are inwardly spaced from the ends of the adjacent projections 22, and are symmetrical with respect to such projections.

Figure 2:
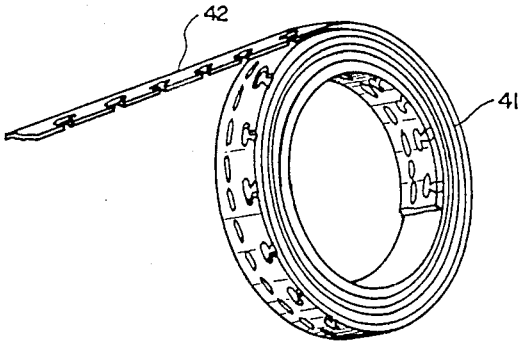
FIG. 2 illustrates the manner in which a carrier in accordance with the present invention is coiled for shipping and storage.

Because the carrier is provided with a hinge line along which the two main portions of the carrier can be bent, it is possible to manufacture the carrier in a flat condition and to then coil it, as illustrated in FIG. 2, for storage and shipment. Such coils may be made several hundred feet long, so that at the time the carrier is to be installed, it is possible to remove from the end of the coil 41 an end portion 42 of substantially any desired length. Therefore, if, for example, a carrier 23 feet long is required to span the entire distance along a wall or ceiling, a piece of carrier 23 feet long can be uncoiled from the coil 41 and cut off. Then the single piece can be installed either before or after bending the carrier along the hinge line 31, as desired. In some instances, it will be desirable to bend the pieces of carrier along the hinge line 31 prior to installation and, in other instances, it will be desirable to install the pieces of carrier in the flat condition and then bend the carrier along the hinge line so that the support portion 28 extends along a plane substantially perpendicular to the mounting portion 27, as illustrated in FIG. 4.

Still further, in some installations, the two portions of the carrier are not bent with respect to each other and remain in a coplanar condition.

Figure 5:
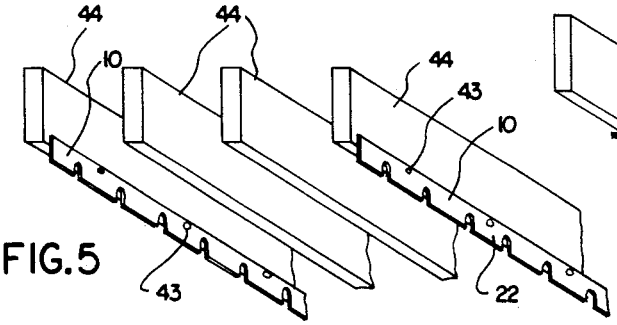
FIG. 5 is a fragmentary, perspective view illustrating the manner in which the carrier may be installed along the side faces of ceiling joists.

FIGS. 5 through 9 illustrate the flexibility of the present invention, which permits it to be installed in a variety of ways. In FIG. 5, the carriers 10 are not bent along the hinge line, but are fastened by screws or nails 43 to the sides of joists 44 so that the projections 22 extend below the lower face of the joists and are positioned to receive linear pans to complete the ceiling structure. In such an installation, the carrier remains flat and is not bent along the hinge line.

Figure 6:
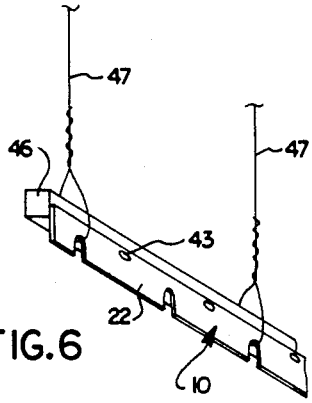
FIG. 6 is a fragmentary, perspective view illustrating the manner in which the carrier may be installed as a suspended ceiling.

FIG. 6 illustrates another manner of using a carrier in accordance with the present invention. In such an installation, the carriers are secured by screws or nails 43 to wood furring strips 46 or the like. Then, the carriers with the furring strips are suspended from the building structure by wires 47 located at intervals along their length to provide a suspended ceiling structure. Here again, in such an installation, the carrier is normally not bent along its hinge line, but is secured to the strips 46 in its flat condition, with the projections 22 extending below the strips 46. In both of the installation embodiments 5 and 6, the mounting portion is secured to a joist or a strip by screws or nails 43 extending through the openings 38.

Figure 7:
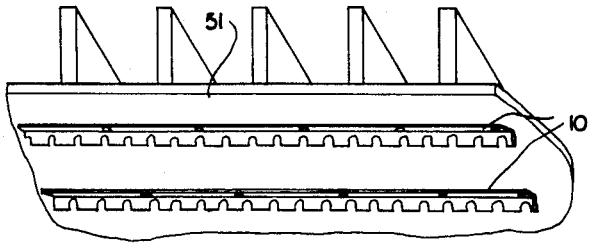
FIG. 7 is a fragmentary, perspective view illustrating the manner in which the carrier may be installed perpendicular to the joists on an existing ceiling structure.
Figure 8:
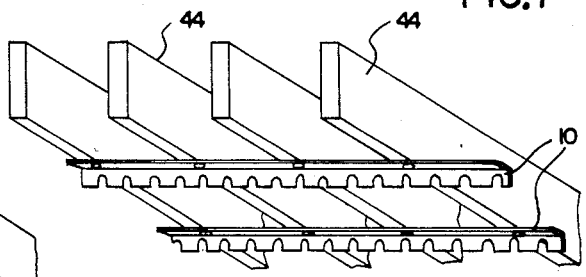
FIG. 8 is a fragmentary, perspective view illustrating the manner in which the carrier may be installed perpendicular to and directly on the ceiling joists.

FIGS. 4, 7, and 8 illustrate the carrier 10 mounted with the mounting portion 27 in a horizontal plane and the support portion 28 bent from the plane of the mounting portion substantially at right angles to the vertical plane. In such an installation, screws or nails 43 are again inserted through openings 38 at intervals along the length of the carrier to mount the mounting portion to the structure of the building. In FIGS. 4 and 7, the carrier is mounted along an existing ceiling 51 so that the mounting portion extends along the surface of the existing ceiling 51 and the carrier portions extend substantially perpendicular thereto.

As mentioned previously, the carrier can be bent along the hinge line 31 either prior to the installation of the screws or nails 43, or after such installation. Because an uninterrupted portion 37 is provided between the hinge line and the notches 32, it is easy to bend the carrier along the hinge line either prior to or after installation. Further, because of the uninterrupted portion 37, the carrier assumes a straight condition after bending.

FIG. 8 illustrates the carriers 10 mounted directly on the lower faces of joists 44 and bent to the L-shape configuration along the hinge line. Preferably, the openings 38 are spaced relatively close together, e.g., at one-inch intervals, so that an opening will exist at each joist to permit a fastener to be installed at each or any joist as desired.

Figure 9:
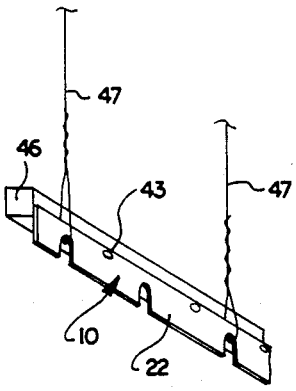
FIG. 9 is a fragmentary side elevation of a carrier installed to provide a curved transition between a wall and a ceiling.
Figure 9:
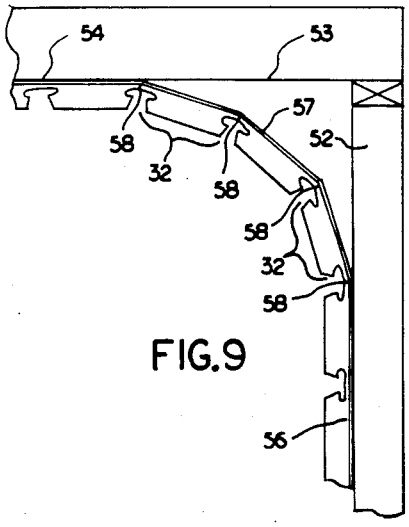

FIG. 9 illustrates the manner in which the carrier can be installed to provide a curved section between a wall 52 and a ceiling 53. In such instance, a portion of the carrier 54 is mounted on the ceiling 53, and another portion 56 of the carrier is mounted on a wall 52. A curved transition portion 57 is provided by cutting the uninterrupted portion 37 by cuts 58 centrally located at each notch 32 and extending to the adjacent slot so that the carrier can be bent (as illustrated in FIG. 9) between each of the projections to provide a relatively smoothly curved transition between the ceiling and the wall. Such cuts formed at 58 can be easily accomplished in the field by the use of hand shears, since the carrier is formed of relatively thin sheet metal. Because the curves are formed at the notches, each of the projections along the curved portion remains dimensionally stable and does not affect the ability of the projections to support linear pans.

With the present invention, a number of advantages are achieved. First, the carrier can be manufactured in a flat condition as a long, continuous strip which is coiled for storage and shipment. Consequently, it is not necessary to package the carrier in separate pieces which are relatively long and difficult to package, store or ship. Further, the carrier can be uncoiled and cut to the required length, eliminating the necessity for installing a series of separate, aligned and abutting carrier strips at the installation site. With this invention, it is possible to cut the carrier to the required full length for installation; therefore, the spacing between adjacent projections is assured throughout the length of the carrier strip.

Still further, the carrier strip, because it is in a flat condition at the time it is cut into pieces for installation, allows the carrier to be easily mounted either on the face or the sides of the framing structure of the building. In fact, as illustrated in FIG. 1, the carriers may be installed prior to bending along the hinge line to facilitate easy installation and then bent along the hinge line to the L-shape configuration after installation. However, in cases where the carrier is to be installed after bending along the hinge line, the carrier provides two uninterrupted sections on each side of the hinge line to maintain the carrier straight. Further, because of its structure, the carrier can be installed in a curved condition to provide a curved section between two surfaces which are not parallel, such as between ceiling and wall surfaces.

Finally, because the carrier is received in long, continuous pieces, and is cut to length at the time of installation, scrap is virtually eliminated.

Although the preferred embodiment of this invention has been shown and described, it should be understood that various modifications and rearrangements of the parts may be resorted to without departing from the scope of the invention as disclosed and claimed herein.

What is claimed is:

1. A linear system for linear walls and ceilings comprising an elongated metal carrier providing a plurality of longitudinally aligned spaced slots dividing said strip into a mounting portion and a support portion, said strip being laterally flat, the material of said strip between said slots providing hinge means, said hinge means operating to cause said strip to sharply bend along a predetermined hinge line extending lengthwise of said strip between said support portion and said mounting portion when lateral bending forces are applied between said mounting portion and said support portion to cause mounting portions and support portions to extend along planes angulated relative to each other and intersecting at said hinge means, said support portion providing a plurality of spaced laterally extending projections, and U-shaped linear pans connected to and supported by said projections, said projections being symmetrically positioned with respect to every other of said slots, the portions of said carrier between said projections being notched to a location spaced from said slots to provide said projections, said notches being substantially aligned with the remaining of said slots, said support portion providing an uninterrupted longitudinal part which cooperates with said mounting portion after said bending along said hinge line to maintain said carriers straight.

2. A linear system as set forth in claim 1, wherein said mounting portion is mounted on a building structure without bending said hinge means.

3. A linear system as set forth in claim 1, wherein said hinge means are bent, said mounting portion being mounted on a building structure, and said support portion extending substantially perpendicular to said mounting portion.

4. A carrier as set forth in claim 1, wherein said carrier is coiled in long lengths for convenient storage and handling and is adapted to be cut into separate pieces for installation, said mounting portion providing openings therein through which mounting fasteners are adapted to extend.

5. A carrier as set forth in claim 1, wherein said mounting portion is secured to an elongated bar to form a carrier bar assembly adapted to be suspended from a building structure to provide a suspended linear ceiling.

* * * * *